US005752579A

United States Patent [19]

Takahashi

[11] Patent Number: 5,752,579

[45] Date of Patent: May 19, 1998

[54] FOOTHOLD

[75] Inventor: Eizo Takahashi, Soka, Japan

[73] Assignee: Miyama Kogyo Kabushiki Kaisha, Saitama-ken, Japan

[21] Appl. No.: 669,909

[22] Filed: Jun. 25, 1996

[30] Foreign Application Priority Data

Jul. 14, 1995 [JP] Japan ..... 7-200216

[51] Int. Cl.[6] ..... E04F 19/00

[52] U.S. Cl. ..... 182/90; 182/92

[58] Field of Search ..... 182/90, 92, 228

[56] References Cited

U.S. PATENT DOCUMENTS

| | | | |
|---|---|---|---|
| 601,849 | 4/1898 | Aiken | 182/92 |
| 2,064,803 | 12/1936 | Grove | 182/90 |
| 4,100,997 | 7/1978 | Peacock | 182/90 |
| 4,241,543 | 12/1980 | Foscarini et al. . | |
| 4,610,330 | 9/1986 | Borst . | |
| 4,655,318 | 4/1987 | Bowen . | |
| 4,660,681 | 4/1987 | Zenhausern . | |
| 4,702,349 | 10/1987 | Zenhausern . | |
| 4,771,861 | 9/1988 | Zenhausern et al. . | |
| 4,778,032 | 10/1988 | Takahashi . | |
| 4,869,342 | 9/1989 | Borst . | |

FOREIGN PATENT DOCUMENTS

| | | |
|---|---|---|
| 0 173 227 | 3/1986 | European Pat. Off. . |
| 4-4040 | 2/1992 | Japan . |
| 470 919 | 8/1937 | United Kingdom . |

*Primary Examiner*—Alvin C. Chin-Shue
*Attorney, Agent, or Firm*—Flynn, Thiel, Boutell & Tanis, P.C.

[57] ABSTRACT

A foothold of a manhole, a quay, and the like which is light and easily handled, and which is excellent in corrosion resistance and strength, and which is easily manufactured and inexpensive and can be recycled. The foothold having a U-shape and comprising a tread at front thereof and legs at both sides thereof, wherein said tread and said legs are integrally formed by engineering plastics.

10 Claims, 4 Drawing Sheets

FOOTHOLD

BACKGROUND OF THE INVENTION

1. Field of the Invention

The present invention relates to a foothold of a manhole, a quay, etc., having a U-shape in plan view and comprising a tread at a front surface and legs at both sides thereof.

2. Prior Art

A conventional foothold of a manhole, a quay, etc., of this type is disclosed, for example, in JP-Y 4-4040 in which the foothold comprises a rod-shaped core made of iron and has an U-shape in plan view wherein a part of the core, particularly a front surface of the core is covered with synthetic resin to form a tread, and another part of the core is not covered with synthetic resin to form legs and is embedded in a wall of the manhole, quay, etc. The upper surface of the tread is formed linear and flat.

However the conventional foothold of a manhole has the following problems. That is, since the core is made of iron, the foothold is heavy, and is difficult to be handled when it is conveyed and fixed to a narrow manhole or a quay having a sharp inclination. Further, since the legs made of iron of the foothold is directly embedded in the wall of the concrete wall of a manhole, quay, etc., the legs are liable to be corroded or damaged, which makes it dangerous when people move up and down thereon.

Further, since the foothold comprises a core made of iron and synthetic resin, the foothold is difficult and expensive to manufacture, and can not be recycled.

Still further, since the upper surface of the tread is formed linear and flat, when people move up and down in the manhole by use of a plurality of footholds arranged vertically in the manhole, a quay, etc., they move up and down in an unstable condition where they are liable to miss their footing from the tread and also they are fatigued with their feet or knees.

SUMMARY OF THE INVENTION

The present invention has been made to solve the aforementioned problems and it is an object of the invention to provide a foothold of a manhole, a quay, etc. which is light and easily handled, and excellent in corrosion resistance and in strength, and also which is easily, inexpensively manufactured and can be recycled.

It is another object of the invention, in addition to the above object, to provide a foothold which enables people to put their feet on the tread in a natural state under a stable condition, and to reduce their fatigue with their feet or knees when they move up and down in the manhole, a quay, etc. by use of the foothold.

To achieve the above object, a foothold of a manhole, a quay, etc., according to a first aspect of the invention is characterized in that legs and a tread are integrally formed by engineering plastics.

A foothold of a manhole, a quay, etc. according to a second aspect of the invention is characterized in that an upper surface of a tread is inclined upward from a central portion of the tread toward side portions of the tread at an angle ranging from 1 to 5 degrees.

PREFERRED EMBODIMENT OF THE INVENTION

Figure 1:
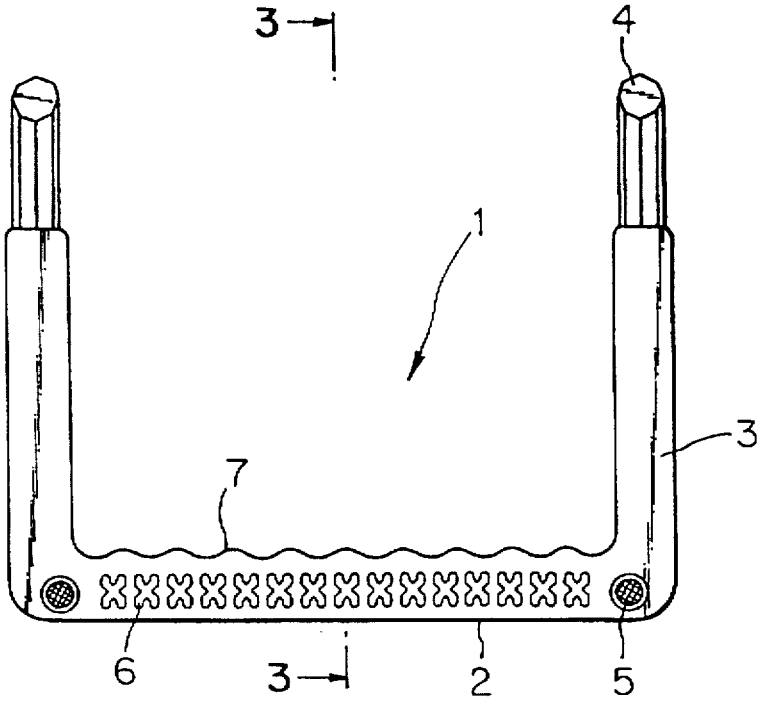
FIG. 1 is a plan view of a foothold of a manhole, a quay, etc., according to a first embodiment of the invention.
Figure 2:
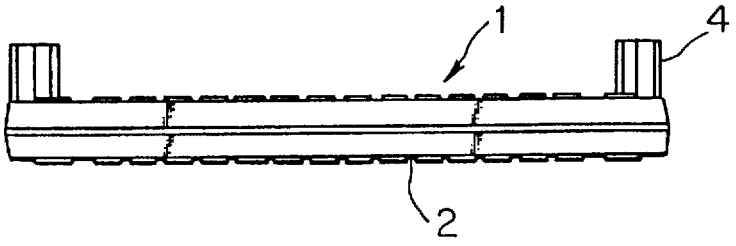
FIG. 2 is a front view of FIG. 1.
Figure 3:
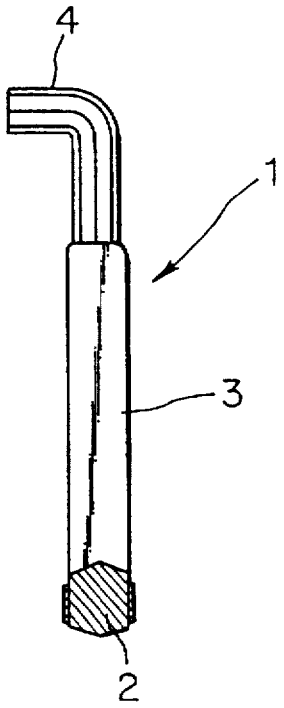
FIG. 3 is a cross sectional view taken along the line 3—3 in FIG. 1.

First Embodiment (FIGS. 1 through 3):

In FIG. 1 through 3 showing a first embodiment of the invention, an entire foothold 1 comprises a tread or step member 2 formed at the front surface thereof, and legs 4 formed at both side portions 3 thereof. Denoted by 5 is reflectors disposed at both ends of the tread 2, 6 is slip prevention patterns, and 7 is a grip portion. The foothold 1 is fixed to a manhole, a quay, etc. in a state where the legs 4 are embedded into concrete of a manhole, a quay, etc.

The tread 2, both of the side portions 3, and the legs 4 constituting the foothold 1 are integrally formed of, for example, engineering plastics such as polyacetal, 6-nylon as polyamide resin.

Since the foothold 1 having the arrangement set forth above is integrally formed of engineering plastics as a whole, the weight of the foothold 1 is lighter than the conventional foothold with a core made of iron, and hence it can be very easily handled when it is conveyed in or fixed to a narrow manhole or a quay having a sharp inclination.

When people move up and down utilizing a plurality of footholds 1 which are provided vertically in the manhole, a quay, etc., they put or step their feet or foot alternately on the tread of each foothold 1. Since the foothold 1 is embedded on a concrete wall of a manhole, a quay, etc., the legs 4 are prevented from being corroded.

Since the foothold 1 is integrally formed of engineering plastics as a whole, it can be easily manufactured, inexpensive and strong. Further, the used foothold 1 is fused by heating and is reformed, and hence it can be easily recycled.

Figure 4:
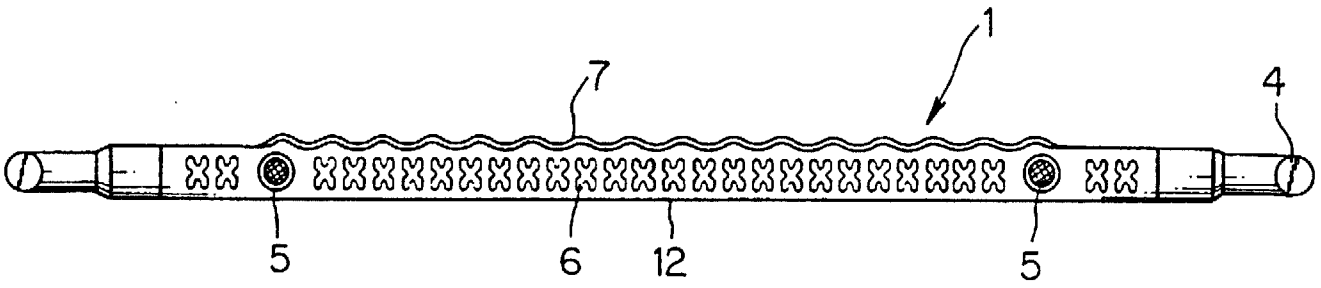
FIG. 4 is a plan view of a foothold of a manhole, a quay, etc. according to a second embodiment of the invention.
Figure 5:
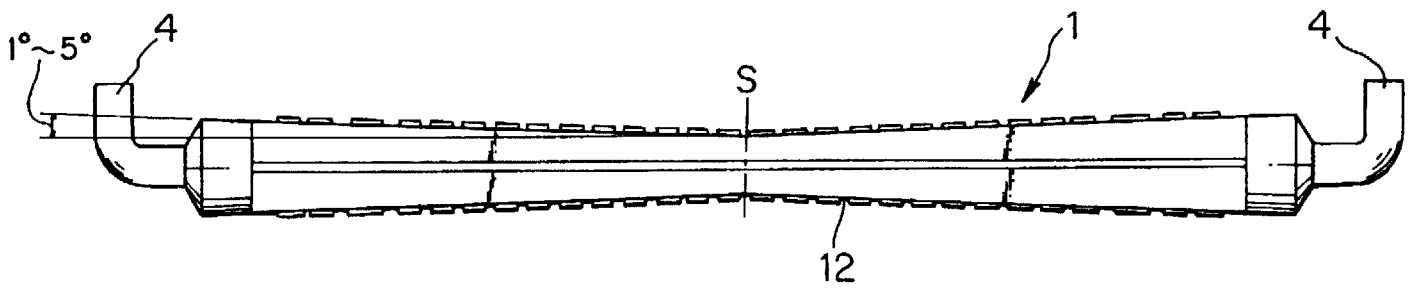
FIG. 5 is a front view of FIG. 4.

Second Embodiment (FIGS. 4 and 5):

FIGS. 4 and 5 show a foothold according to a second embodiment.

The foothold of the second embodiment is substantially the same as that of the first embodiment except that the thickness of the tread is gradually increased from a central portion toward side portions at an upper surface thereof at an angle ranging from 1 to 5 degrees. Accordingly, components which are the same as those of the first embodiment are denoted by the same numerals, and explanation thereof is omitted.

In the second embodiment, the foothold 1 can be easily handled when it is conveyed and fixed to the manhole, the quay, etc. like the first embodiment, and other effects can be obtained like the first embodiment. That is, the legs of the foothold are not corroded by concrete of the manhole, the quay, etc. even if they are embedded therein, and the foothold is easily manufactured, inexpensive, strong and can be recycled. Further, since the upper surface of the tread is inclined upward from the center thereof to both sides thereof at an angle ranging from 1 to 5 degrees, when people move up and down in the manhole by use of a plurality of footholds arranged vertically in a manhole, a quay, etc., they move up and down in a stable condition where they are not liable to miss their footing from the tread and also they are not fatigued with their feet or knees.

According to the first aspect of the invention, since the foothold is integrally formed of engineering plastics as a whole, the weight of the foothold is lighter than the conventional foothold employing the conventional core made of iron, and can be easily handled when it is conveyed and fixed to the narrow manhole, or the quay having sharp inclination, or the like. Further, the legs of the foothold are not corroded by concrete of the manhole, the quay, etc., namely, it has excellent corrosion resistance, and it can be easily manufactured, inexpensive, strong, and also it can be recycled.

According to the second aspect of the invention, since the upper surface of the tread is inclined upward from the center thereof to both sides thereof at an angle ranging from 1 to 5 degrees, when people move up and down in the manhole by use of a plurality of footholds arranged vertically in a manhole, a quay, etc., they move up and down in a natural state under a stable condition where they are not liable to miss their footing from the tread and also they are not fatigued with their feet or knees. Thus the invention has improved ergonomics.

What is claimed is:

1. A foothold comprising a U-shaped body having two legs and an elongate tread section extending therebetween, said two legs extending outwardly from said tread section, said tread section including an inclined portion which inclines longitudinally portion of said tread section toward one end of said tread section and is adapted for engagement with one foot of a person to reduce fatigue in the foot and leg, said inclined portion having a slip prevention pattern thereon for engagement by the foot of the person for preventing slippage, said inclined portion being inclined at an angle within a range of 1° to 5° relative to horizontal for improving the ergonomics of said tread section, said inclined portion inclining divergingly along oppositely directed first and second surfaces in a direction toward said one end for allowing said U-shaped body to be used as a foothold in both a first orientation with said first surface facing upwardly and in a second orientation wherein the body is rotated vertically about 180° from said first orientation so that said second surface faces upwardly.

2. The foothold according to claim 1, wherein said tread section has a second inclined portion which inclines longitudinally toward the other end of said tread section and is also adapted for engagement with the other foot of the person to reduce fatigue in the foot and leg, said second inclined portion being inclined at an angle within a range of 1° to 5° for improving the ergonomics of said tread section, said center portion of said tread section joining said inclined portion and said second inclined portion, and said second inclined portion inclining divergingly along oppositely directed third and fourth surfaces in a direction toward said other end of said tread section for allowing said U-shaped body to be used as a foothold in said first orientation with said first and third surfaces facing upwardly adapted to receive both feet thereon and in said second orientation with said second and fourth surfaces facing upwardly adapted to receive both feet thereon.

3. The foothold according to claim 2, wherein said tread section is symmetrical about a vertical plane extending through said center portion transversely to said tread section.

4. The foothold according to claim 2, wherein a face of said tread section extending between said first and second surfaces has a grip portion thereon adapted to engage fingers on a hand of the person.

5. The foothold according to claim 4, wherein one said leg is cantilevered from said third face adjacent said first end of said tread section, and a second said leg being cantilevered from said third face adjacent the other end of said tread section.

6. The foothold according to claim 5, wherein said U-shaped body is an engineered plastic member.

7. The foothold according to claim 1, wherein said U-shaped body is an engineered plastic member.

8. A foothold comprising a U-shaped body having two legs and an elongate tread section extending therebetween, said two legs extending outwardly from said tread section, said tread section including a first inclined portion which inclines longitudinally toward one end of said tread section and is adapted for engagement with one foot of a person to reduce fatigue in the foot and leg, said first inclined portion having a slip prevention pattern thereon for engagement by the foot of the person for preventing slippage, said first inclined portion being inclined at an angle within a range of 1° to 5° relative to horizontal for improving the ergonomics of said tread section, said tread section including a second inclined portion which inclines longitudinally toward the other end of said tread section at an angle between 1° and 5° relative to horizontal for improving the ergonomics of said tread section, a center portion joining said first and second inclined portions, said second inclined portion being adapted for engagement by the foot to reduce fatigue in the foot and leg, said first and second inclined portions defining a top surface of said tread section having a generally V-shaped configuration, a third and fourth inclined portions defining a bottom surface of said tread section, said bottom surface being oppositely directed from said top surface, said inclined portions incline divergingly along said top and bottom surfaces toward said one and other ends respectively of said tread section, said bottom surface having a V-shaped configuration, and said U-shaped body being usable as a foothold in both a first orientation with said top surface facing upwardly and a second orientation wherein said U-shaped body is rotated vertically 180° from said first orientation so that said bottom surface faces upwardly.

9. The foothold according to claim 8, wherein said tread section is symmetrical about a vertical plane extending through said center portion.

10. The foothold according to claim 8, wherein said U-shaped body is an engineered plastic member.

* * * * *

UNITED STATES PATENT AND TRADEMARK OFFICE

CERTIFICATE OF CORRECTION

PATENT NO. : 5 752 579

DATED : May 19, 1998

INVENTOR(S) : Eizo Takahashi

It is certified that error appears in the above-indentified patent and that said Letters Patent is hereby corrected as shown below:

Column 3, line 25; after "longitudinally" insert ---from a central---.

Signed and Sealed this

Tenth Day of November 1998

*Attest:*

*Attesting Officer*

BRUCE LEHMAN

*Commissioner of Patents and Trademarks*